US007305929B2

(12) United States Patent
MacDonald et al.

(10) Patent No.: US 7,305,929 B2
(45) Date of Patent: Dec. 11, 2007

(54) TWO PIECE VIEW PORT AND LIGHT HOUSING WITH SWIVEL LIGHT

(75) Inventors: Ian MacDonald, Fort Lauderdale, FL (US); Randal Rash, Fort Lauderdale, FL (US)

(73) Assignee: Underwater Lights USA, LLC, Fort Lauderdale, FL (US)

( * ) Notice: Subject to any disclaimer, the term of this patent is extended or adjusted under 35 U.S.C. 154(b) by 0 days.

(21) Appl. No.: 11/724,700

(22) Filed: Mar. 16, 2007

(65) Prior Publication Data

US 2007/0215027 A1 Sep. 20, 2007

Related U.S. Application Data

(60) Provisional application No. 60/783,195, filed on Mar. 16, 2006.

(51) Int. Cl.
*B63B 19/00* (2006.01)

(52) U.S. Cl. ..... 114/173; 362/267

(58) Field of Classification Search ..... 441/135; 114/66, 173; 362/267
See application file for complete search history.

(56) References Cited

U.S. PATENT DOCUMENTS

| | | | | |
|---|---|---|---|---|
| 404,390 | A * | 6/1889 | Dutton | 359/503 |
| 1,675,965 | A * | 7/1928 | Weinreich | 114/66 |
| 1,989,443 | A * | 1/1935 | Arnold | 294/66.2 |
| 4,245,281 | A | 1/1981 | Ziaylek, Jr. | |
| 4,259,710 | A | 3/1981 | Schlack | |
| 4,303,967 | A | 12/1981 | Letsche | |
| 4,360,859 | A | 11/1982 | Ziaylek, Jr. | |
| 4,445,163 | A | 4/1984 | Ziaylek, Jr. | |
| 4,472,769 | A | 9/1984 | Hoke et al. | |
| 4,503,489 | A | 3/1985 | Duerr et al. | |
| 4,574,337 | A | 3/1986 | Poppenheimer | |
| 4,674,013 | A | 6/1987 | Manzoni | |
| 4,675,793 | A | 6/1987 | Capellari et al. | |
| 5,023,765 | A | 6/1991 | Barton | |
| 5,230,559 | A | 7/1993 | Porter et al. | |
| 5,450,303 | A | 9/1995 | Markiewicz et al. | |
| 5,649,760 | A | 7/1997 | Beadle | |
| 5,722,770 | A | 3/1998 | Douglas | |
| 5,887,966 | A | 3/1999 | Eissner et al. | |
| 5,906,431 | A | 5/1999 | Chianale et al. | |
| 6,089,733 | A | 7/2000 | Chen | |
| 6,106,134 | A | 8/2000 | Bomas | |
| 6,115,060 | A | 9/2000 | Rowley | |
| 6,161,948 | A | 12/2000 | Hagen | |
| 6,262,761 | B1 | 7/2001 | Zemov et al. | |
| 6,652,124 | B2 | 11/2003 | Schubert et al. | |
| 6,779,908 | B1 | 8/2004 | Ng | |
| 6,860,624 | B2 | 3/2005 | Hille et al. | |
| 6,966,679 | B2 | 11/2005 | Matts et al. | |
| 2006/0239013 | A1 * | 10/2006 | Olsson et al. | 362/362 |
| 2007/0137544 | A1 * | 6/2007 | MacDonald et al. | 114/173 |

* cited by examiner

*Primary Examiner*—Stephen Avila
(74) *Attorney, Agent, or Firm*—Lott & Friedland, P.A.; Michael J. Keller

(57) ABSTRACT

The present invention is a view port suitable for installation under the water line of a vessel wherein the view port comprises a flange made from a corrosion resistant material and a body made from a heat resistant material. An alternative embodiment of the invention is an underwater light in which a high intensity discharge light is installed into the above mentioned view port. The light may be swiveled while installed in the view port in order to direct the light along a desired path.

32 Claims, 6 Drawing Sheets

TWO PIECE VIEW PORT AND LIGHT HOUSING WITH SWIVEL LIGHT

This application claims priority to corresponding U.S. Provisional Application No. 60/783,195, filed on Mar. 16, 2006, which is related to, cross-references and incorporates by reference the subject matter of U.S. Provisional Application No. 60/715,625, filed on Sep. 9, 2005, and U.S. Provisional Application No. 60/781,678, filed on Mar. 13, 2006, the disclosures and contents of which are expressly incorporated herein by reference.

BACKGROUND OF THE INVENTION

Underwater view ports have been used on ships, boats or other watercraft for decorative and safety purposes as well as to aid exploration of the surrounding water. Similarly, lighting has been applied to these same watercraft to improve visibility during the dark hours or during periods of overcast or cloudy conditions. Lights have been applied so as to illuminate the sides of the watercraft in order to better visualize the watercraft from a distance, to further enhance the appearance of the watercraft, and to illuminate the surrounding water area. Lights have been mounted in various locations on the deck or hull of the watercraft to accomplish this purpose.

Conventional view ports use a frame to mount a substantially transparent window to the hull. Smaller view ports have used a single piece thru-hull having a mechanically or chemically fastened window inside the thru-hull fitting.

Thru-hull mounted lights are often in the form of light strips composed of a string of high intensity light bulbs contained within a housing or a plurality of individual lights within a housing applied externally along the perimeter of the hull and oriented to shine downwards along the side of the hull. Various applications of the housings and light shields are used to redirect the light rays from the light source downward along the surface of the hull (including the ability to adjust the housings in order to project beams along a desired path). Although such configurations provide substantial illumination of the hull sides, they are not waterproof or watertight and therefore are placed substantially higher than the waterline. Therefore, little to no illumination of the surrounding water area is provided as the light intensity fades considerably from the light source as it reaches the waterline. Furthermore, because the light rays are directed downward along the surface of the hull, illumination is restricted primarily to the line of the watercraft. Therefore, the light rays do not deviate outward into the surrounding water and may be easily obstructed by other accessories attached to the hull sides of the watercraft that are closer to the waterline. Also, lights mounted on the exterior of the boat often require replacement and repair from outside the boat rather than from the inside of the boat which is usually fairly cumbersome.

In order to better project the light onto the surface of the water from a light source placed above the waterline, the lights have been extended outward such that they are spaced away from the sides of the hull surface. For example, U.S. Pat. No. 5,355,149 discloses a utility light apparatus that is mounted on the gunwale of a boat by applying the light to the distal end of a conventional fishing rod holder such that the light extends out over the side of the boat in an arm-like fashion. Therefore, the extended light pathway illuminates more of the water's surface and is less likely to be obstructed by other appurtenances placed on the side of the boat. However, unless the height of the boat is relatively shallow, the depth to which the light penetrates the water is still very limited by the light intensity as the light source is placed well above the waterline at the gunwale of the boat. Thus, the conventional hull or deck mounted lights do not provide sufficient lighting for visualizing harmful objects within the path of the watercraft or exploring the water around and below the watercraft. Furthermore, lights extending outward from the surface of the boat are easily damaged in comparison to lights which are integrated into the surface area of the boat such that they are only slightly protruding or not protruding at all.

More recently, lights have been integrated into the hull surface area of a watercraft by placing the lights into the thru-hull fittings of the hull thereby providing a watertight lighting apparatus which may be positioned below the waterline in order to significantly improve visualization of the surrounding water area and to enhance the aesthetics of the boat. Also, by placing the light assembly inside a thru-hull, replacement or repair can be done from the inside of the boat where access is normally much simpler than from outside the boat. Typically, a light bulb or lamp-supporting means is placed inside the thru-hull from inside the boat and a secured lens is placed between the lamp and the exterior opening of the thru-hull such that the light passes through the lens and into the water. The light bulb or lamp-supporting means is surrounded by a housing that is either cylindrical for secure fit against the sides of the thru-hull or is a conical, tapered piece which narrows towards the interior of the boat. A flange placed flush against the outside surface of the thru-hull and one or a series of O-rings or watertight sealants or adhesives are used to provide a watertight seal between the lens and the exterior opening of the thru-hull. The exterior flange is usually cast as one piece with a housing that penetrates the hull. The single casting then requires considerable machining to allow for placement of lenses and accessories which make use of the view port. Alternative constructs include manufacture of the housing and flange in two pieces which are then welded together. Welded configurations have the drawback in that if identical materials are not used, welding is difficult and the integrity of the weld may be suspect when used in an underwater environment where failure could be catastrophic.

The flange may be formed with the light housing as one piece or may be separate from the housing such that it is removably attached to the side of the hull by screws that are screwed into holes bored into the hull surface or by snapping it into place.

Furthermore, current thru-hull light configurations greatly restrict the useful ability to change the beam angle at which the light passes through the lens and into the water after the initial installation of the light housing within the thru-hull. The light bulb or lamp-supporting means is usually secured tightly to the housing such that the angle of the light can only be altered by dislodging the entire housing from the inside of the thru-hull and reinstalling the housing at a different angle. There usually lacks the space within the thru-hull to install the entire light housing at an angle as the light housing is usually sized to fit snuggly against the interior walls of the thru-hull for a watertight fit. The flange or other watertight means at the exterior of the thru-hull usually restricts the light housing to a single orientation against the boat thereby precluding alteration of the angle altogether. Hull or transom lights that include means for adjusting the light angle with respect to the light housing, such as those disclosed in U.S. Pat. Nos. 4,245,281, 4,360,859, and 4,445,163, consist generally of a fixed light retaining member with a spherical or arcuate surface which mates with the spherical or arcuate surface of the light shield member such that the light shield member swivels with respect to the light retaining member. Either tightening screws or compressible materials (e.g. rubber) are required to maintain the adjusted angle in such configurations. Resilient retaining clips or several pivot-mounted brackets are also used in swivel lighting fixtures found in different applications. The use of compressible or resilient materials lacks the benefit of using metals which greatly increase the valuable heat dissipation characteristics of an underwater lighting device. Furthermore, multiple brackets and screws are ill-suited for use in the compact space of a thru-hull where there is limited access to the adjusting device.

It is also desirable to form the light housing and the flange from two different types of metals in order to obtain the highest heat dissipating light housing on the interior of the hull and the most anti-corrosive flange on the exterior of the hull where the assembly comes into contact with the water. A one-piece configuration limits the entire assembly to one type of metal. Even where the flange and light housing are welded together, there are many metals which cannot be welded tightly to one another. Where the flange must be attached to the hull by screws, several screw-holes must be bored into the hull thereby damaging the hull surface and providing additional inlets where water moisture can create damage. Where the flange is snapped into place, it is difficult to obtain a substantially watertight seal between the flange, lens and the exterior opening of the thru-hull.

It is an object of this invention to provide a two-piece thru-hull light in which the flange and light housing are two separate pieces such that numerous combinations of metals may be used for their construction in order to provide a highly efficient assembly. Furthermore, the flange has a threaded surface which is screwed into the exterior surface of a cylindrical light housing thereby not damaging the hull surface and providing a substantially watertight seal.

It is also an object of this invention to secure the lighting apparatus to the hull in such a way that the hull is not damaged. The flange is comprised of a mushroom-head shaped portion that is placed flush against the exterior surface of the hull opening. On the interior side of the hull opening, a compression ring surrounding the exterior surface of the light housing is compressed against the hull's interior surface by a threaded locking ring thereby securing the hull between the flange and the compression ring. The locking ring compresses the compression ring against the hull by way of several screws whose ends abut the surface of the compression ring.

It is also an object of this invention that the cylindrical light housing may be adjustable so as to adapt to slight angle variations of the thru-hull sides with respect to the actual thru-hull opening on the exterior surface of the hull. Many thru-hull configurations use a ball and socket type of joint in order to allow the light housing angle to be adjusted. In the present invention, the screws which are threaded through the locking ring that serve to secure the compression ring against the interior surface of the hull may be threaded individually at different heights thereby tilting the compression ring at various angles in order to accommodate the thru-hull shape.

It is also an object of this invention that the light bulb or camera means may be pivoted at different angles in situ after the initial installation without having to dislodge and safely reinstall the housing at a different angle while the light or camera is still on. In the present invention, a reflector holder that surrounds the light bulb may be pivoted within the housing by a threaded ball screw attached to the distal end of the reflector holder which is adjustable at the distal end of the main body from the interior of the thru-hull. The reflector holder rotates within a Teflon split front cup at the interior side of the lens as the threaded ball screw is tilted.

DETAILED DESCRIPTION OF THE INVENTION

The present invention is a two-piece thru-hull view port assembly constructed to have a watertight fit in the hull or deck of a vessel. Uses for the view port assembly include, but are not limited to, a port or window for viewing using the naked eye or as a housing for one or more lights or cameras for still photography or video.

Figure 1A:
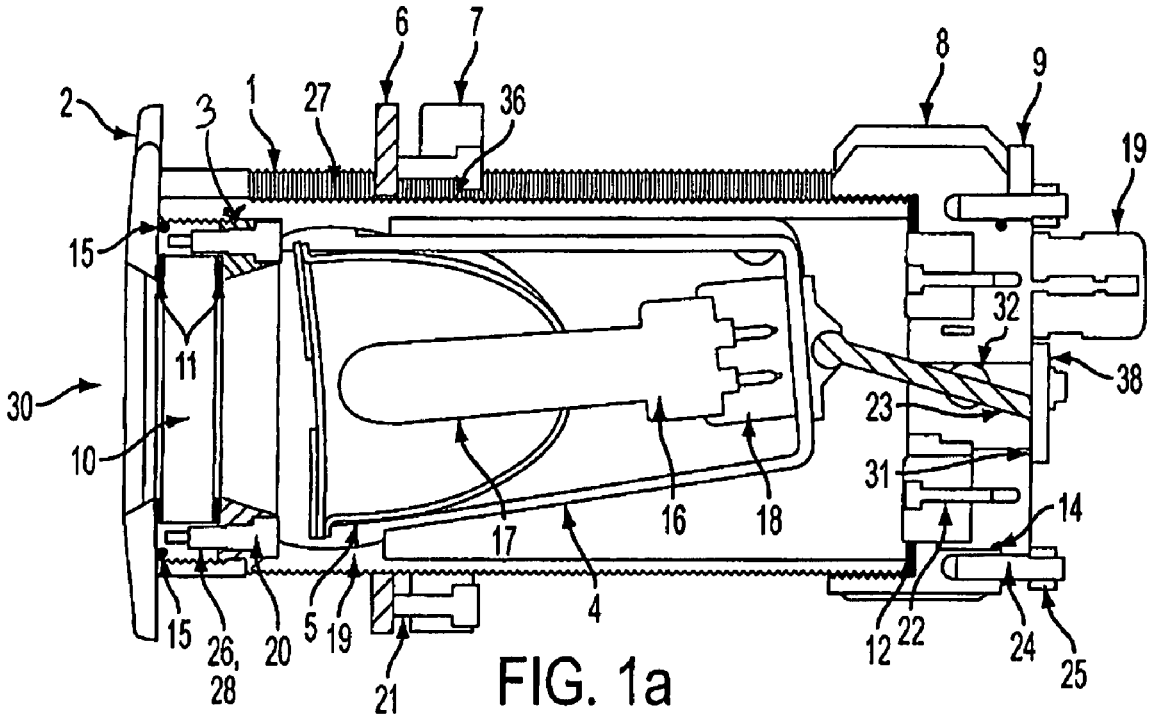
FIG. 1*a* is a cross-sectional view of a view port housing a light at a pivoted angle.
Figure 1B:
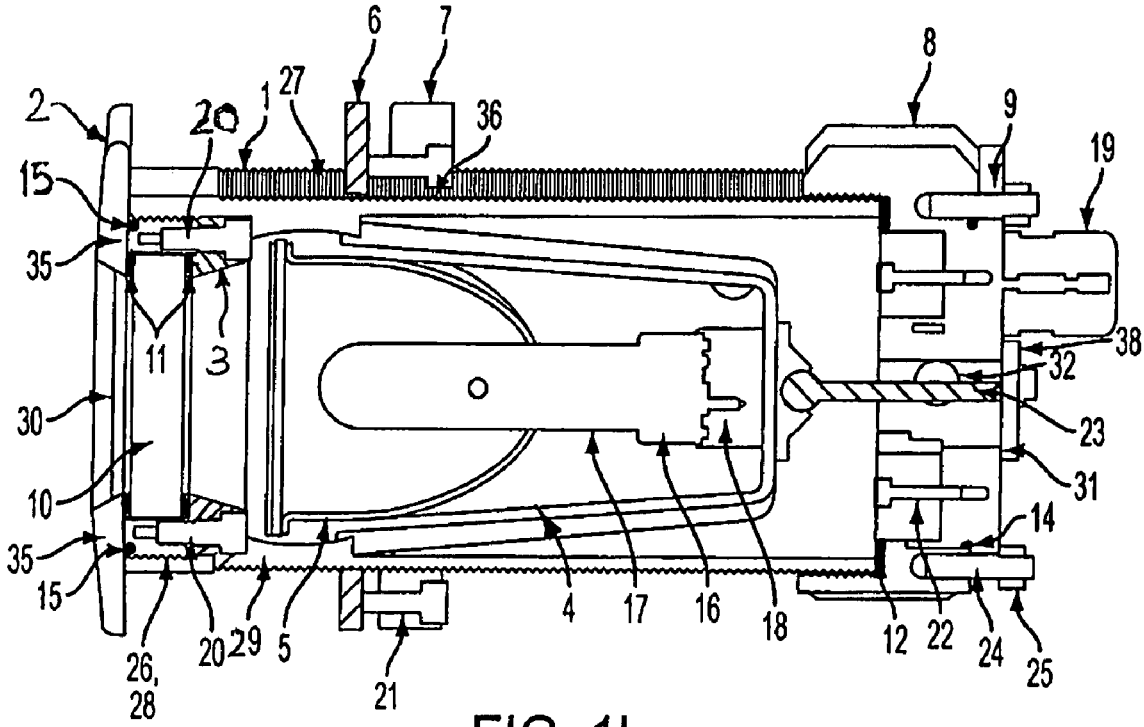
FIG. 1*b* is a cross-sectional view of a view port housing a light at a non-pivoted 0° degree angle.
Figure 2A:
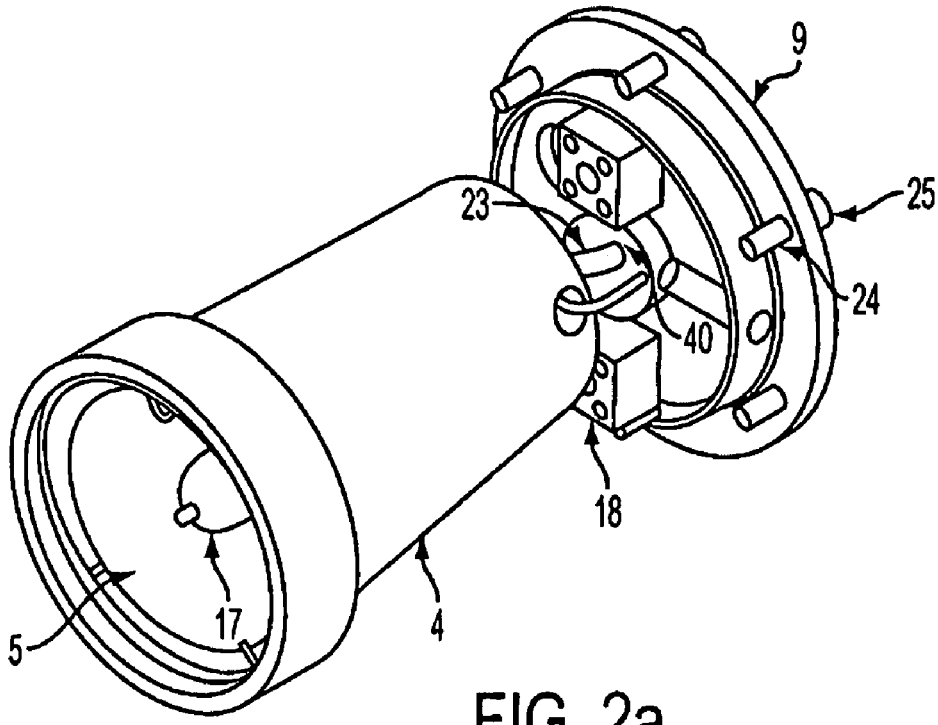
FIG. 2*a* is a view of the reflector housing with a lid at a pivoted angle.
Figure 2B:
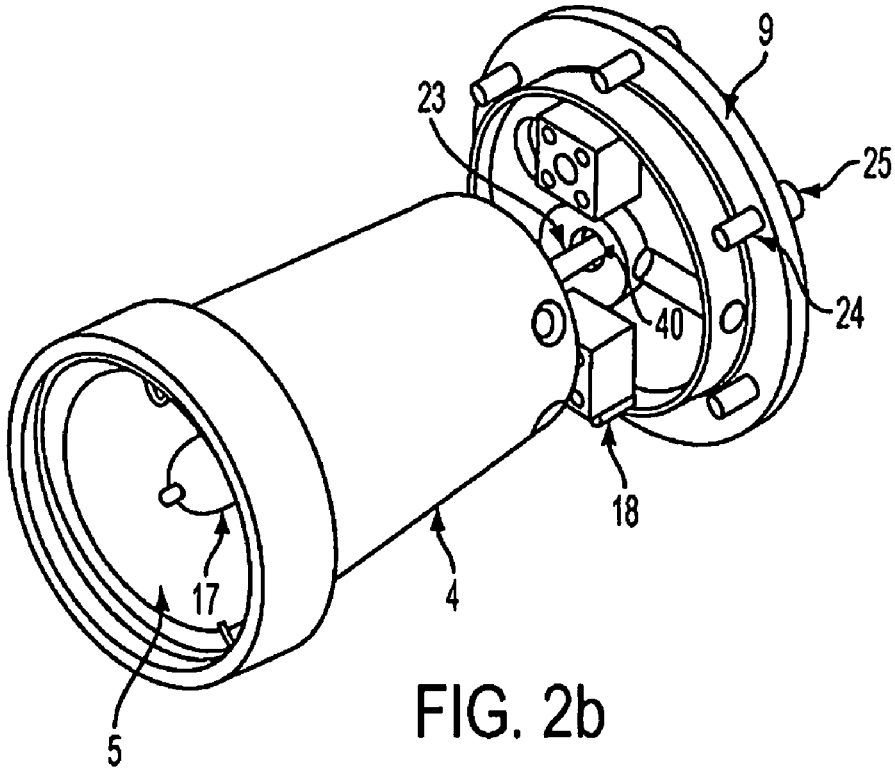
FIG. 2*b* is a view of the reflector housing with a lid at a non-pivoted 0° degree angle.

Referring to FIGS. 1*a* and 1*b*, a flange 2 having an inner and outer face is used as the exterior mounting to the vessel. A substantially transparent lens 10 having a top and a bottom surface is removably mounted on the inner surface of flange 2 and provides the window for viewing.

Lens 10 is in the shape of a disc with grounded round edges and is preferably composed of heat and pressure resistant borosilicate. As will be appreciated by one of ordinary skill in the art, any substantially transparent material that is resistant to high temperature and high pressure and is resistant to erosion and chemicals may be used. Suitable materials include chemically hardened or tempered, impact-resistant materials such as quartz glass, tempered (Pyrex), borosilicate, or sapphire crystal. The lens is retained in place by a lens retaining ring 3 and flange 2 which is connected to the circumference of the lens retaining ring via cap screws 20.

The interior surface of lens retaining ring 3 is tapered such that the proximal end is of narrower diameter than the distal end. The hollow interior of the mushroom-head shaped portion of the flange is tapered inward such that the proximal end is of wider diameter than the distal end and the distal end is of narrower diameter than the threaded portion of the flange. The diameter of the distal end of the mushroom-head shaped portion of the flange is equal to the diameter of the proximal end of the lens retaining ring thereby forming a retaining groove between the mushroom-shaped portion of the flange and the lens retaining ring for capturing the lens. Gaskets 11 are placed on both sides of the lens in order to form a watertight seal between the lens and the flange and the lens and lens retaining ring. Gaskets 11 are preferably 1/16" thick and composed of compressed Aramid/Buna-N sheet gasket material. The inner surface of flange 2 contains a plurality of threaded screw holes 35 to which a lens retaining ring 3 having a circumferential body defining a lens opening 30 is affixed using screws or bolts 20 threaded into screw holes 35.

The main body 1 of the view port assembly is a hollow cylinder with an interior surface having internal threads 26 and an exterior surface having external threads 27. The main body 1 is attached to flange 2 by threading the internal threads 26 of the main body onto the external threads 28 of flange 2. A polymer o-ring 15 or other suitable sealing means such as silicone, polyether, polyurethane or other sealants acceptable for use below the waterline are used for forming a watertight seal between flange 2 and main body 1. The view port assembly is secured to the inside of the vessel hull using a locking ring 7 having internal threads 36 which are sized to screw down onto the external threads 27 of main body 1. Locking ring 7 pulls flange 2 into position against the outside of the vessel hull as it is being threaded onto main body 1. The locking ring is preferably composed of aluminum.

Optionally, in order to adapt the entire view port assembly to slight angular variations in hull shapes, a compression ring 6 in combination with locking ring 7 is provided along the exterior mid-portion of main body 1. Although the mushroom-head shaped portion of flange 2 must stay flush against the side of the boat at the hull opening, the compression ring and locking ring may be adjusted such that the main body of the assembly may tilt slightly in order to accommodate angle variations in the hull. The compression ring is preferably composed of aluminum and has a smooth interior and exterior surface. The compression ring surrounds the exterior of the mid-portion of the main body and acts as a washer separating the main body from the walls of the hull. The corners of the compression ring are beveled so as to provide smooth contact with the walls of the hull. Along the circumference of the locking ring are cap screws 21 whose bodies extend past the locking ring and abut the distal side of the compression ring. In order to vary the angle at which the compression ring aligns the assembly within the walls of the hull, each of screws 21 may be individually threaded into the bores of the locking ring at different heights so as to change the angle of the abutting compression ring.

In one embodiment of the view port, flange 2 can be directly welded to the vessel hull. When welded, there is no need to bed the flange to the hull to reduce leaks and the internal locking and compression rings are eliminated.

The advantage of using a two-piece thru-hull to define a view port is that the individual components can be manufactured from the most preferred materials for the environment and/or application. Certain material choices for the water-contacting portion of the present invention require the use of metals having sufficient structural strength and corrosion resistance to maintain a watertight seal below the waterline. In contrast, materials used inside the hull must have sufficient mechanical strength for securing fastening to the flange and should have appropriate heat transfer properties to minimize heat build up in the view port. Table 1 is a list of the galvanic potential of various common metals starting with magnesium which is the most reactive and ending with platinum which is the least reactive.

TABLE 1

Galvanic Properties of Various Common Metals

| Most Reactive | Least Reactive |
|---|---|
| Magnesium | Copper (Ca102) |
| Magnesium Alloys | Manganese Bronze (Ca675), Tin Bronze (Ca903, 905) |
| Zinc | Silicon Bronze |
| Aluminum 5052, 3004, 3003, 1100, 6053 | Nickel Silver |
| Cadmium | Copper - Nickel Alloy 90-10 |
| Aluminum 2117, 2017, 2024 | Copper - Nickel Alloy 80-20 |
| Mild Steel (1018), Wrought Iron | 430 Stainless Steel |
| Cast Iron, Low Alloy High Strength Steel | Nickel, Aluminum, Bronze (Ca630, 632) |
| Chrome Iron (Active) | Monel 400, K500 |
| Stainless Steel, 430 Series (Active) | Silver Solder |
| 302, 303, 304, 321, 347, 410, 416, Stainless Steel (Active) | Nickel (Passive) |
| Ni - Resist | 60 Ni-15 Cr (Passive) |
| 316, 317, Stainless Steel (Active) | Inconel 600 (Passive) |
| Carpenter 20 Cb-3 Stainless (Active) | 80 Ni-20 Cr (Passive) |
| Aluminum Bronze (Ca687) | Chrome Iron (Passive) |
| Hastelloy C (Active) Inconel 625 (Active) Titanium (Active) | 302, 303, 304, 321, 347, Stainless Steel (Passive) |
| Lead - Tin Solders | 316, 317, Stainless Steel (Passive) |
| Lead | Carpenter 20 Cb-3 Stainless (Passive), Incoloy 825 |
| Tin | Nickel - Molybdeum - Chromium - Iron Alloy (Passive) |
| Inconel 600 (Active) | Silver |
| Nickel (Active) | Titanium (Pass.) Hastelloy C & C276 (Passive), Inconel 625(Pass.) |
| 60 Ni-15 Cr (Active) | Graphite |
| 80 Ni-20 Cr (Active) | Zirconium |
| Hastelloy B (Active) | Gold |
| Brasses | Platinum |

For water-contacting surfaces, it is preferred to use materials that are less reactive and that have the appropriate mechanical properties for the application. Standard marine fittings are generally made of bronze or 316 or 317 stainless steel for both their strength and corrosion resistance when used below the waterline. While these materials offer excellent corrosion resistance, they do not dissipate heat well. As such, they are less preferred for use in applications where heat may be generated such as in a light or camera housing. When the assembly will hold a heat emitting or radiating device, it is preferred that the body of the assembly be made from materials capable of rapidly dispersing the heat, such as aluminum or copper. However, most grades of aluminum create a galvanic cell and corrode rapidly when immersed in an aqueous environment in the presence of any other metals. In the marine environment, other metals are always present in the form of standard bronze thru-hull plumbing fittings, bronze and stainless propellers, rudder hardware etc. Further, saltwater is an excellent electrolyte and fosters the creation of galvanic currents. As such, aluminum is a poor choice for any external use on any vessel hull and in no instance should aluminum be directly welded or affixed to steel hull vessels. While plastics do not corrode and have been used in thru-hull devices, they lack the sufficient strength and durability for use in applications that are below the waterline. They are also cosmetically unappealing in comparison to highly polished metals.

The present invention allows for the use of corrosion resistant materials on the wet outside of the vessel hull and the use of heat dissipating materials on the dry inside of the vessel hull. For example, the flange can be made of a corrosion resistant metal such as bronze, stainless steel or titanium and the body can be made of a strong heat dissipating metal such as aluminum, titanium or brass or alloys thereof.

When used to house a light or camera, a reflector housing 4 is slip-fit or optionally threaded into the inside of the main body. While primary water resistance is provided by flange 2 and o-ring 15, secondary water resistance can be provided by use of a threaded cap 38 which is screwed onto the distal end of the main body. This cap may be a single piece or preferably two pieces comprising a threaded connector ring 8 and a lid 9. The cap may be made out of any suitable metal or polymer material, although marine grades of aluminum are most preferred due to their ability to rapidly dissipate heat.

O-rings or gaskets 12 and 14 are used to maintain a watertight seal between connector ring 8 and the main body and between lid 9 and connector ring 8. When lid 9 is used it is most preferred lid 9 is secured to the distal end of connector ring 8 via a plurality of screws 24 in combination with locknuts 25 which are placed around the lid's circumference. The external surface of the cap or connector ring may be shaped for use with tools or contain ridges or other means to improve a hand grip when screwing or unscrewing the connector ring or cap from the main body. The connector ring and cap can also assume any design which does not interfere with its mechanical function. Such designs include aesthetically pleasing designs and designs to improve the heat dissipation of the cap or connector ring. Heat dissipation may be improved by the inclusion of a plurality of cooling fins, ridges or other means to increase the surface area for heat dissipation or to facilitate additional air flow around or through portions of the cap, connector ring and/or lid.

When used with a wired device such as a lamp or camera, the lid contains a cable strain relief structure 19 for coupling to a cable that originates from inside the boat and provides power to and/or a signal from the device mounted inside the view port assembly. Signals transmitted include still or video images or infrared or other sensors capable of receiving data through a view port. Porcelain terminal blocks 18 serve to electrically and mechanically connect the lamp socket 16, camera or sensor structure to the lid via cap screws 22. The lamp socket may be elongated as necessary to place the lamp in the optimal location within the reflector housing for light and heat dissipation or alternatively the socket can be position using spacers between the socket and the lid. Also, non-conducting standoff bodies may be placed between the terminal block and lid so as to change the placement of the terminal block with respect to the lid when needed. The lamp socket contains a lamp 17 which may be one of several types including halide, halogen or xenon gas.

When used as a lamp, a reflector housing 4 is a tube 4 that is mounted inside and adjacent to the hollow interior of the main body. The reflector tube 4 houses lamp 17 and supports a reflector 5 at its proximal end. The reflector tube is preferably composed of a heat dissipating material such as aluminum and is shaped such that the distal end of the reflector tube is affixed between the distal end of the main body and the connector ring and the proximal end is secured between the proximal end of the reflector tube and lens retaining ring 3. While any suitable mechanical retaining means is acceptable, the use of a lip on the proximal and distal ends for retaining the reflector tube is most preferred.

For a watertight connection within the reflector tube, gasket 12 is placed between the lip of the reflector tube and the connector ring. Any heat and water resistant gasket material such as Aramid/Buna-N sheet gasket material can be used for gasket 12. A resilient polymer o-ring 14, preferably composed of nitrile rubber, lies between the distal ends of the reflector tube and main body so as to ensure a watertight seal between the reflector tube and adjacent components.

Reflector 5 has a parabolic curved surface which protrudes rearward into the hollow interior of the assembly towards the distal end. Lamp 17 extends through the circular aperture at the center of the parabolic surface such that the reflector serves to provide maximum light projection and brightness from lamp 17.

In order to replace or repair the lamp or camera, the connector ring 8 is accessed from inside the hull and is unscrewed such that the connector ring and lid assembly, which is connected to the lamp or camera, may be removed in the distal direction. The remaining components of the lighting assembly remain in the thru-hull thereby leaving a sealed viewing hole in place during repair.

Figure 6:
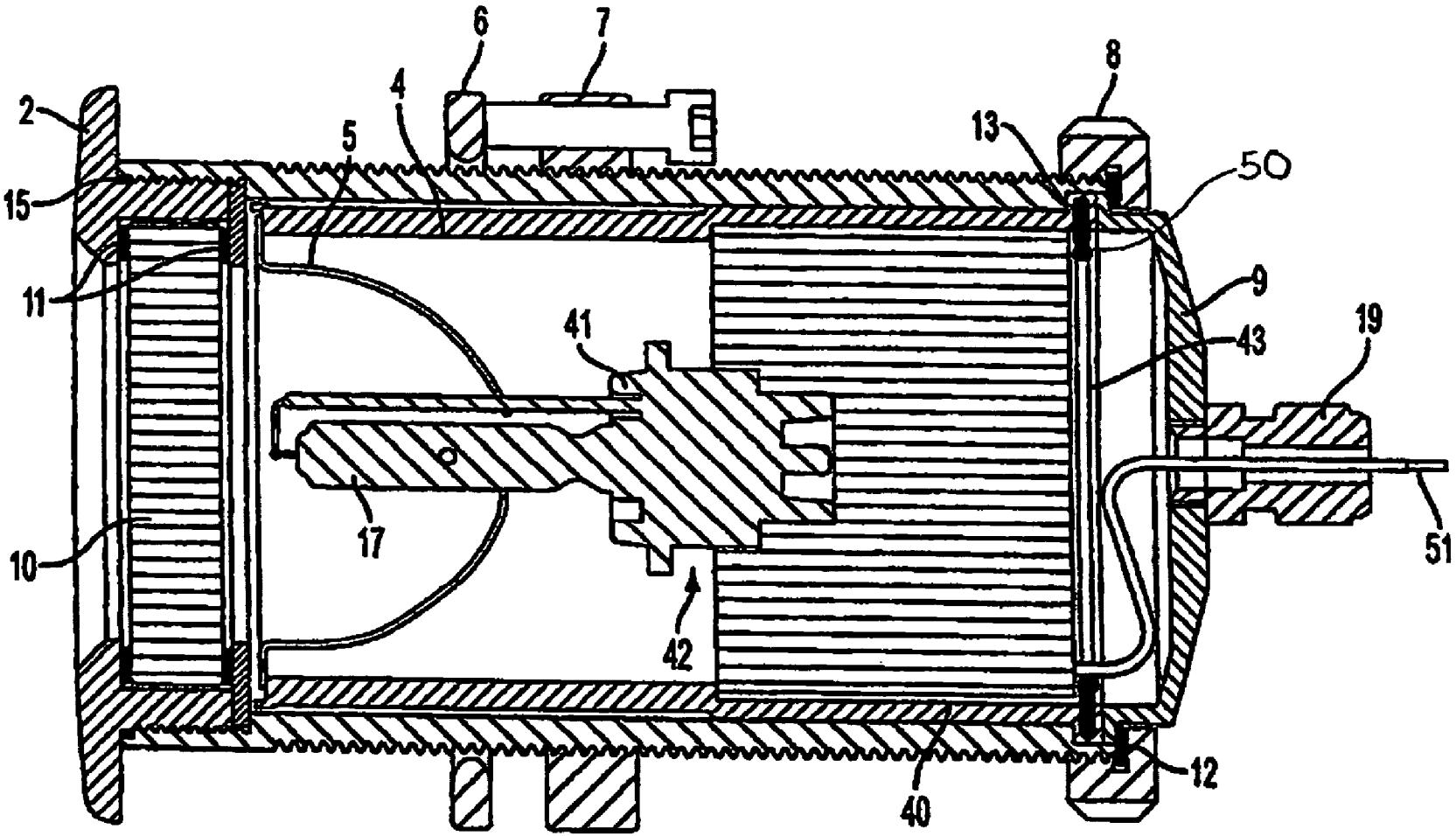
FIG. 6 is a cross-sectional view of the two-piece view port and light housing with a high intensity discharge lamp and integral ballast in a fully-assembled configuration.

Referring to FIG. 6, where lamp 17 is a high intensity discharge lamp, an electric ballast 40 must be used in order to provide the proper electrical starting and operating current and voltages to the lamp. Typically, a lamp support structure is physically separated from the ballast structure such that the ballast structure is found outside the lamp housing. In the present invention, placing the ballast structure outside the watertight thru-hull housing will subject the ballast and the connecting wires between lamp 17 and the ballast structure to the dangerous effects of moisture or require the ballast to be placed some distance from the lamp structure, reducing the ability of the ballast to adequately operate the lamp. A remedy is provided by bringing ballast 40 inside the thru-hull housing so as to extend the watertight protections of the thru-hull piece to the ballast structure and lamp connections as well. FIG. 6 depicts ballast 40 as replacing the lamp-retaining mechanism of lamp socket 16 and porcelain terminal block(s) 18 as are shown in FIG. 1. Accordingly, the ballast is now directly connected to the lamp 17 and is directly wired to the switch and power supply (not shown) through wires 51. Ballast 40 has a cylindrical body, preferably constructed of aluminum, such that its diameter fits snuggly within the diameter of the reflector housing 4 at the distal end of the main body. As mentioned above, ballast 40 has an integrated lamp socket 41 such that lamp 17 may be directly plugged into the ballast structure. However, in no way is this description meant to limit the present embodiment to a ballast with an integrated lamp socket.

Figure 4:
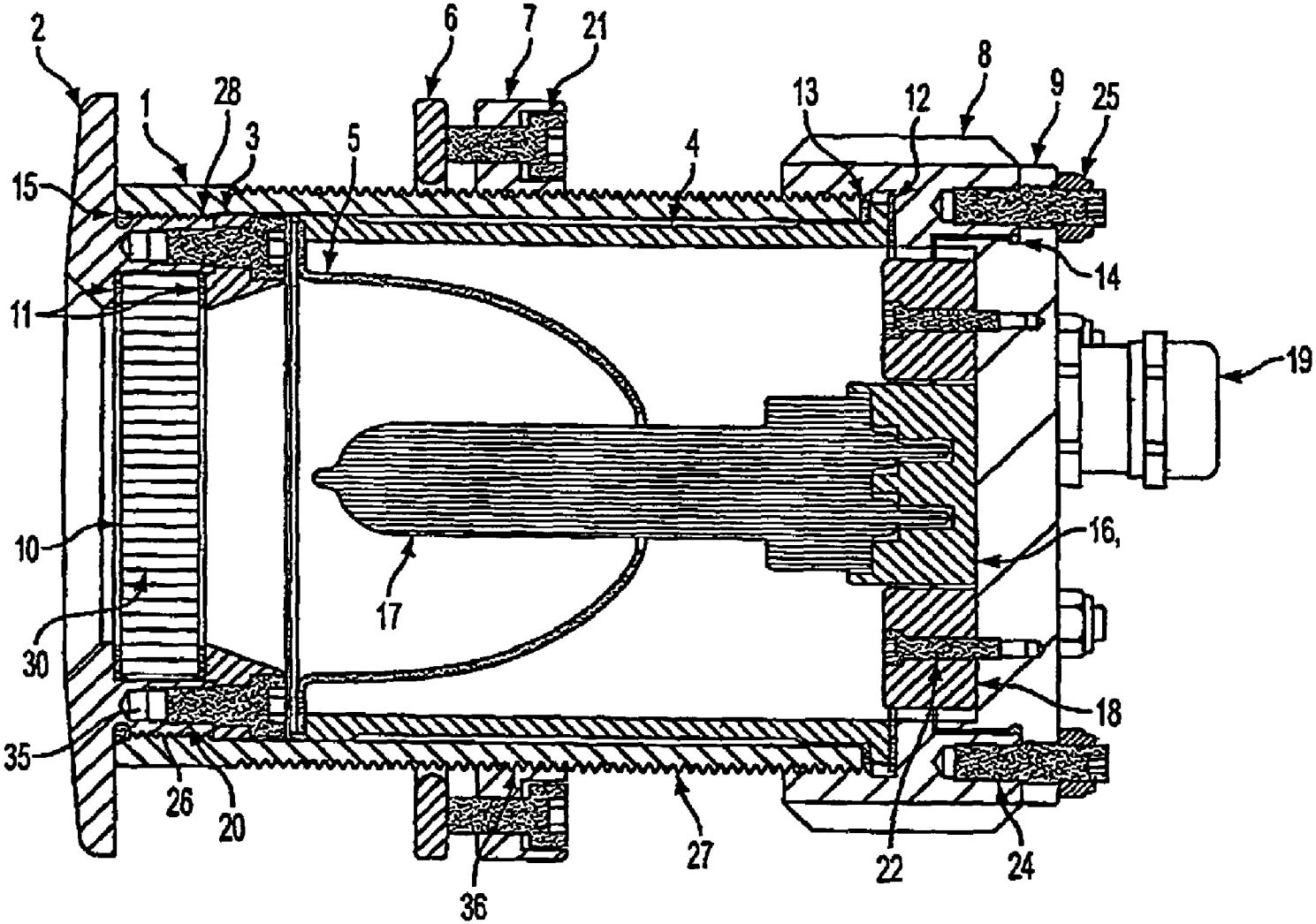
FIG. 4 is a cross-sectional view of the two-piece view port and light housing in a fully-assembled configuration.
Figure 5B:
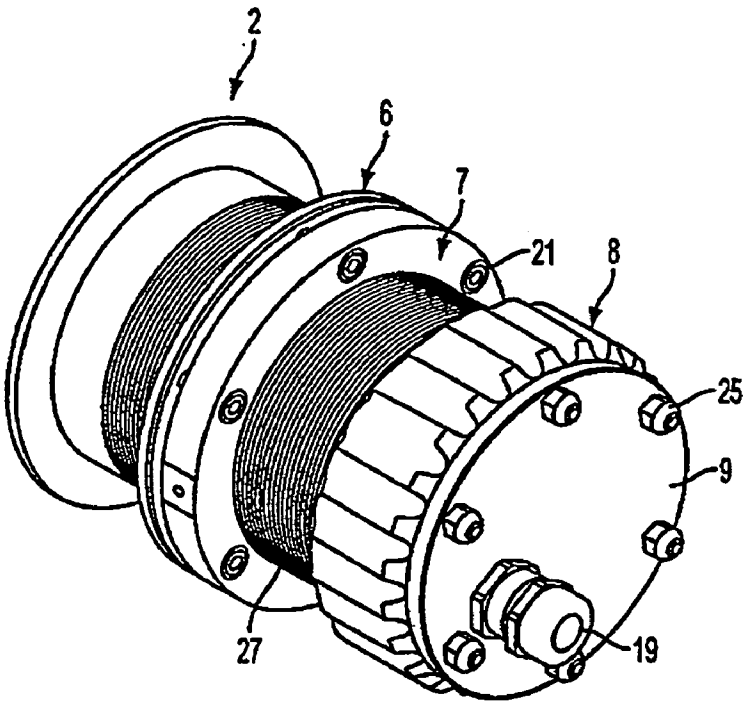
FIGS. 5*a* and 5*b* are oblique views of the two-piece view port having a watertight end cap.
Figure 5A:
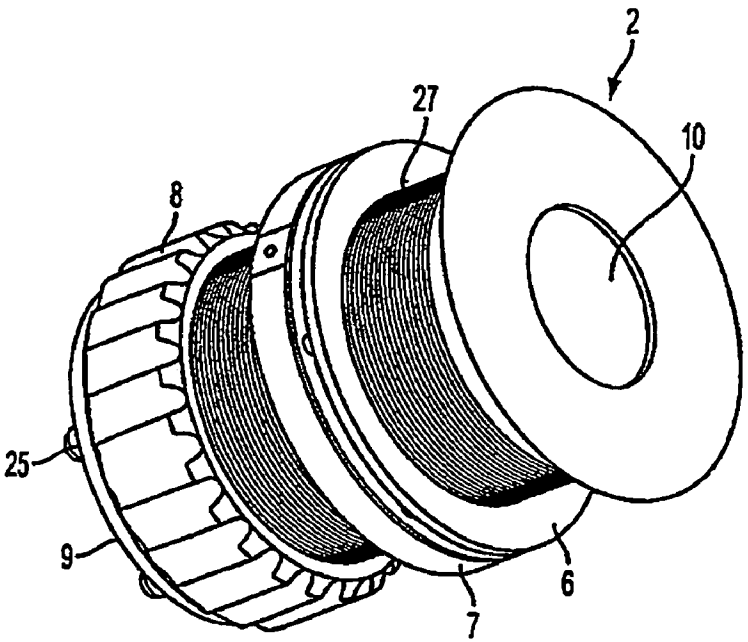

With the removal of lamp socket 16 and porcelain terminal block(s) 18 as described above, cap screws 22 (as were depicted in FIGS. 1*a*, 1*b* and 4) are no longer needed to secure the lamp assembly to lid 9. The distal end of the main body may be enclosed by a threaded cap which may be screwed onto the main body. This cap may be a single piece or preferably two pieces comprising a threaded connecting ring 8 and a lid 9 whereby lid 9 abuts the distal end of reflector housing 4 and is secured in place by connecting ring 8. The light and ballast assembly 42 are retained in the reflector housing 4 by means of a wire pull-handle 43. The pull-handle 43 fits into holes 50 on either side of the reflector housing and allows for easy removal of the assembly 42 for changing bulbs or performing other maintenance on the light.

Figure 3A:
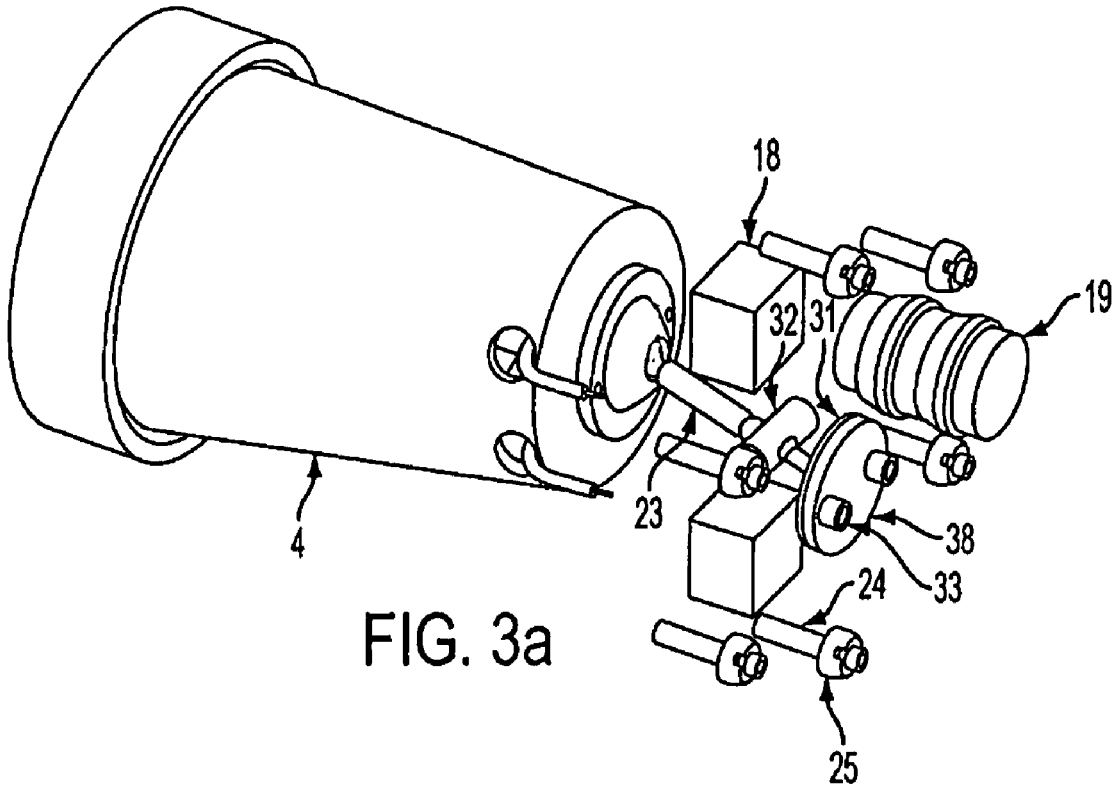
FIG. 3*a* is another view of the reflector housing at a pivoted angle.
Figure 3B:
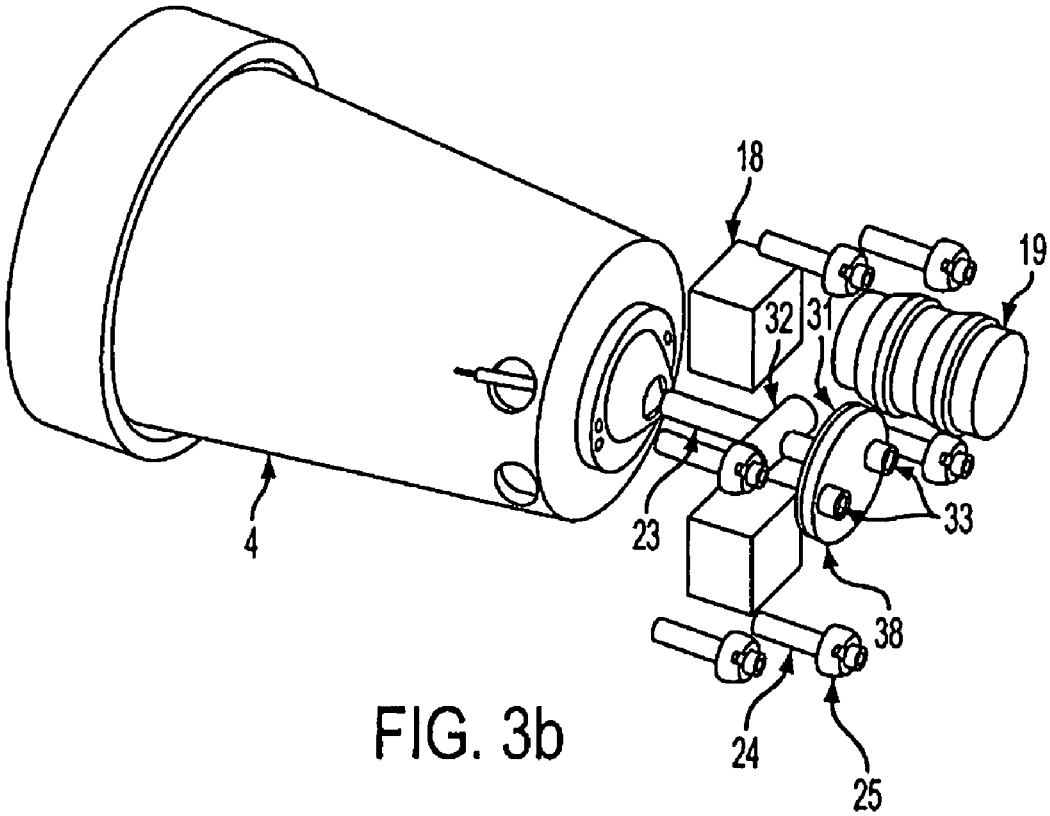
FIG. 3*b* is another view of the reflector housing at a non-pivoted 0° degree angle.

Referring to FIGS. 1*a* and 1*b* in order to adjust the angle of the reflector housing 4 such that the beam angle of the light or camera is changed, a threaded ball screw 23 is attached to the distal end of the reflector housing such that as the ball screw is tilted, the reflector housing swivels to form a new beam angle. The proximal end of reflector housing 4 is contained within a Teflon split front cup 29 such that the reflector housing may swivel smoothly within the light housing. A set screw 32 that is integral with lid 9 locks the ball screw into position after being adjusted in order to maintain the desired angle. To tilt the ball screw, a hole 40 in lid 9 is provided such that when cap 38 is removed from lid 9 by unscrewing two socket head cap screws 33 (as shown in FIGS. 3*a* and 3*b*), the ball screw may be tilted by way of the exposed hole in lid 9 without removing the entire lid 9 and/or the connector ring 8. Furthermore, such configuration allows for lamp 17 to remain safely on while adjusting the angle. A lid cap gasket 31 provides a watertight seal between lid 9 and cap 38.

As is apparent to one of ordinary skill in the art, various details of the present invention can be modified without deviating from the scope and spirit of the present invention. For example, in order to tilt or otherwise adjust the angle of the reflector housing, it is contemplated that the reflector housing may be adjusted manually or by remote device wherein motors or other accessories are attached to the light housing that may be controlled by remote device. Also, the use of alternative materials such as metals, sealants, polymers and transparent glasses are contemplated and expected as improvements are made in the relevant art.

We claim:

1. A thru-hull assembly comprising:

a cylindrical, hollow main body placed in the interior of a thru-hull that is comprised of a light housing and has exterior threaded surfaces and interior threaded surfaces;

an annular external flange that is removably attached to the main body and is comprised of a mushroom-head shaped portion to be placed flush against the exterior opening of the thru-hull and a narrower cylindrical portion with a threaded exterior surface for mating with the threaded surface of the main body;

a lens sized to fit the annular opening of the external flange;

a means for securing the lens to the external flange;

a means for providing a watertight seal on both sides of said lens;

a cap removably attached to the distal end of the main body having a lamp socket affixed thereto and a means for conducting power to the lamp socket;

a lamp mounted in the lamp socket;

a means for adjusting the angle of the lamp without removing the lamp from inside the housing; and a means for securing the housing to a vessel.

2. The thru-hull assembly of claim 1 wherein the means for securing the housing to a vessel is selected from bonding, welding or mechanical fastening.

3. The thru-hull assembly of claim 2 wherein the mechanical fastening means is a locking ring.

4. The thru-hull assembly of claim 3 wherein the locking ring is used with a compression ring.

5. The thru-hull assembly of claim 1 wherein the means for securing the lens to the external flange is selected from bonding or mechanical fastening.

6. The thru-hull assembly of claim 5 wherein the mechanical means for securing the lens to the external flange is a lens retaining ring.

7. The thru-hull assembly of claim 1 wherein the means for providing a watertight seal is selected from sealants, o-rings, gaskets or mechanical seals.

8. The thru-hull assembly of claim 7 where the means for providing a watertight seal is a gasket.

9. The thru-hull assembly of claim 1 further comprising a cap threaded onto the distal end.

10. The thru-hull assembly of claim 9 further comprising a source of light.

11. The thru-hull assembly of claim 10 wherein the light is selected from halogen, xenon gas or metal halide lamps.

12. The thru-hull assembly of claim 9 further comprising a camera.

13. The thru-hull assembly of claim 1 wherein the external flange and the housing are comprised of two different metals.

14. The thru-hull assembly of claim 13 wherein the flange is comprised of a highly corrosion resistant material.

15. The thru-hull assembly of claim 13 wherein the housing is comprised of a heat dissipating metal.

16. A thru-hull assembly comprising:

an annular external flange that is removably attached to the main body and is comprised of a mushroom-head shaped portion to be placed flush against an exterior opening of a vessel and a narrower cylindrical portion with a threaded exterior surface;

a cylindrical, hollow main body placed in the interior of a thru-hull that is comprised of a light housing and has exterior threaded surfaces and interior threaded surfaces for mating to the threaded portion of the external flange;

a lens sized to fit the annular opening of the external flange;

a means for securing the lens to the external flange;

a means for providing a watertight seal on both sides of said lens;

a reflector housing sized to fit inside the main body comprising a reflector;

a cap removably attached to the distal end of the main body having a lamp socket affixed thereto and a means for conducting power to the lamp socket;

a lamp mounted in the lamp socket;

a means for adjusting the angle of the lamp without removing the lamp from inside the housing; and a means for securing the housing to a vessel.

17. The thru-hull light of claim 16 wherein the means for adjusting the angle of the lamp is by a pivoting member affixed to the reflector housing.

18. The thru-hull light of claim 17 wherein the pivoting member is a threaded ball screw.

19. The thru-hull light of claim 16 wherein the means for securing the housing to a vessel is selected from bonding, welding or mechanical fastening.

20. The thru-hull light of claim 19 wherein the mechanical fastening means is a locking ring.

21. The thru-hull light of claim 20 wherein the locking ring is used with a compression ring.

22. The thru-hull light of claim 16 wherein the means for securing the lens to the external flange is selected from bonding or mechanical fastening.

23. The thru-hull light of claim 22 wherein the mechanical means for securing the lens to the external flange is a lens retaining ring.

24. The thru-hull light of claim 16 wherein the means for providing a watertight seal is selected from sealants, o-rings, gaskets or mechanical seals.

25. The thru-hull light of claim 24 wherein the means for providing a watertight seal is a gasket.

26. The thru-hull light of claim 16 wherein the lamp is selected from halogen, xenon gas or metal halide lamps.

27. The thru-hull light of claim 16 further comprising a camera.

28. The thru-hull light of claim 16 wherein the flange and the housing are comprised of two different metals.

29. The thru-hull light of claim 28 wherein the flange is comprised of a highly corrosion resistant material.

30. The thru-hull light of claim 29 wherein the flange is selected from stainless steel, bronze or titanium.

31. The thru-hull light of claim 28 wherein the housing is comprised of a heat dissipating metal.

32. The thru-hull light of claim 31 wherein the housing is selected from aluminum, titanium or brass.

* * * * *